US009683346B2

(12) United States Patent
Birnhack

(10) Patent No.: US 9,683,346 B2
(45) Date of Patent: Jun. 20, 2017

(54) PERFORATED STRUCTURE MOUNTABLE ONTO A SEABED

(71) Applicant: OCEAN BRICK SYSTEM (O.B.S.) LTD., Jerusalem (IL)

(72) Inventor: Kobi Birnhack, Jerusalem (IL)

(73) Assignee: OCEAN BRICK SYSTEMS (O.B.S.) LTD., Jerusalem (IL)

( * ) Notice: Subject to any disclaimer, the term of this patent is extended or adjusted under 35 U.S.C. 154(b) by 0 days.

(21) Appl. No.: 14/957,639

(22) Filed: Dec. 3, 2015

(65) Prior Publication Data

US 2016/0083924 A1 Mar. 24, 2016

Related U.S. Application Data

(63) Continuation-in-part of application No. 14/498,012, filed on Sep. 26, 2014, now abandoned, which is a (Continued)

(51) Int. Cl.
*E02B 17/02* (2006.01)
*E02B 3/06* (2006.01)
(Continued)

(52) U.S. Cl.
CPC ..... *E02B 17/025* (2013.01); *E02B 3/06* (2013.01); *E02B 3/20* (2013.01); *E02B 17/0017* (2013.01);
(Continued)

(58) Field of Classification Search
CPC ..... B63B 35/44; B63B 35/4413; B63B 2035/4426; E02B 17/00; E02B 17/02; E02B 17/025; E02B 2017/0039
See application file for complete search history.

(56) References Cited

U.S. PATENT DOCUMENTS 1,816,095 A 7/1931 Stanford
3,115,013 A 12/1963 Thornley
(Continued)

FOREIGN PATENT DOCUMENTS

FR 2621004 3/1989
FR 2871484 12/2005
(Continued)

OTHER PUBLICATIONS

"The Big Ships Are Coming", J. Svendsen, J. Tiedemann, A feature of Jan Svendsen's and Jan Tiedemann's Containership-Info, http://www.containership-info.com/, (Jul. 17, 2007).
(Continued)

*Primary Examiner* — Frederick L Lagman

(57) ABSTRACT

A perforated structure mountable onto a seabed for establishing a deep-water port or an artificial island comprises: a plurality prefabricated perforated modules integratable into said structure; and at least one connector interconnecting corner portions of said prefabricated perforated modules. Each prefabricated perforated module has a corner portion comprising a concave surface such that said corner portions being integrated together into said structure form a cavity to be filled with a concrete. The connector comprises a crosspiece having three arms orthogonal to each other; each arm has a cross-like cross section. The crosspiece has reinforcing members at least partially mechanically connectable to said corner portions.

2 Claims, 10 Drawing Sheets

Related U.S. Application Data continuation-in-part of application No. 13/144,394, filed as application No. PCT/IL2010/000036 on Jan. 14, 2010, now abandoned, and a continuation-in-part of application No. 13/319,750, filed as application No. PCT/IL2010/000372 on May 9, 2010, now abandoned.

(60) Provisional application No. 61/144,745, filed on Jan. 15, 2009, provisional application No. 61/176,910, filed on May 10, 2009.

(51) Int. Cl.

| | |
|---|---|
| ***E02D 29/16*** | (2006.01) |
| ***E02D 27/52*** | (2006.01) |
| ***E02B 3/20*** | (2006.01) |
| *E02B 17/00* | (2006.01) |

(52) U.S. Cl.

CPC ..... *E02D 27/52* (2013.01); *E02D 29/16* (2013.01); *E02B 2017/0039* (2013.01)

(56) References Cited

U.S. PATENT DOCUMENTS

| | | | | | |
|---|---|---|---|---|---|
| 3,383,869 | A | | 5/1968 | Jarlan | |
| 3,614,866 | A | | 10/1971 | Kaneko et al. | |
| 3,663,346 | A | * | 5/1972 | Schoen | B64C 3/00 428/116 |
| 3,665,882 | A | * | 5/1972 | Georgiev | B63B 35/34 114/266 |
| 3,765,353 | A | | 10/1973 | Rosenberg | |
| 3,822,499 | A | * | 7/1974 | De Vos | A63H 33/108 114/267 |
| 3,844,125 | A | | 10/1974 | Williams | |
| 3,877,233 | A | | 4/1975 | Olsen | |
| 3,958,426 | A | | 5/1976 | Heien | |
| 4,023,370 | A | | 5/1977 | Watson | |
| 4,067,285 | A | | 1/1978 | Jones et al. | |
| 4,225,268 | A | | 9/1980 | Treu | |
| 4,347,017 | A | | 8/1982 | Chevallier | |
| 4,502,816 | A | | 3/1985 | Creter et al. | |
| 4,554,883 | A | * | 11/1985 | Lane | B63B 9/065 114/266 |
| 4,978,247 | A | | 12/1990 | Lenson | |
| 5,036,635 | A | * | 8/1991 | Lalvani | A63H 33/04 52/80.1 |
| 5,215,027 | A | | 6/1993 | Baxter | |
| 5,242,243 | A | | 9/1993 | Bachelier | |
| 5,375,550 | A | | 12/1994 | Innis | |
| 5,393,169 | A | | 2/1995 | Creter | |
| 5,505,035 | A | * | 4/1996 | Lalvani | A63B 9/00 52/311.2 |
| 5,620,280 | A | | 4/1997 | Melby et al. | |
| 5,623,790 | A | * | 4/1997 | Lalvani | A63B 9/00 52/79.1 |
| 5,707,172 | A | | 1/1998 | Wilcox | |
| 5,803,659 | A | | 9/1998 | Chattey | |
| 6,017,167 | A | | 1/2000 | Chattey | |
| 6,089,175 | A | | 7/2000 | Toki et al. | |
| 6,125,780 | A | | 10/2000 | Sweetman et al. | |
| 6,234,714 | B1 | | 5/2001 | Chattey | |
| 6,408,780 | B1 | | 6/2002 | Ozaki et al. | |
| 6,491,473 | B2 | | 12/2002 | Veazey | |
| 6,669,403 | B2 | | 12/2003 | Clark et al. | |
| 6,830,411 | B1 | | 12/2004 | Amari | |
| 7,007,620 | B2 | | 3/2006 | Veazey | |
| 7,226,245 | B2 | | 6/2007 | Kent et al. | |
| 2004/0018055 | A1 | | 1/2004 | Clark et al. | |
| 2008/0038067 | A1 | | 2/2008 | Sharapov | |
| 2009/0173269 | A1 | | 7/2009 | Brown et al. | |
| 2009/0217855 | A1 | | 9/2009 | Wang et al. | |
| 2010/0075400 | A1 | | 3/2010 | Kania et al. | |
| 2011/0002739 | A1 | | 1/2011 | Howland | |

FOREIGN PATENT DOCUMENTS

| | | |
|---|---|---|
| JP | 1999166221 | 6/1999 |
| JP | 2001003367 | 1/2001 |
| JP | 2004530822 | 10/2004 |
| WO | 90/08059 | 7/1990 |
| WO | 03/002827 | 1/2003 |
| WO | 2005/012073 | 2/2005 |
| WO | 2005/085055 | 9/2005 |
| WO | 2010/082198 | 7/2010 |
| WO | 2010/131246 | 11/2010 |

OTHER PUBLICATIONS

International Search Report of PCT/IL2010/000036, dated Nov. 4, 2010.
Written Opinion of PCT/IL2010/000036, dated Jul. 15, 2011.
International Preliminary Report on Patentability of PCT/IL2010/000036, dated Jul. 19, 2011.
International Search Report of PCT/IL2010/000372, dated Nov. 18, 2010.
Written Opinion of PCT/IL2010/000372, dated Nov. 10, 2011.
International Preliminary Report on Patentability of PCT/IL2010/000372, dated Nov. 10, 2011.

* cited by examiner

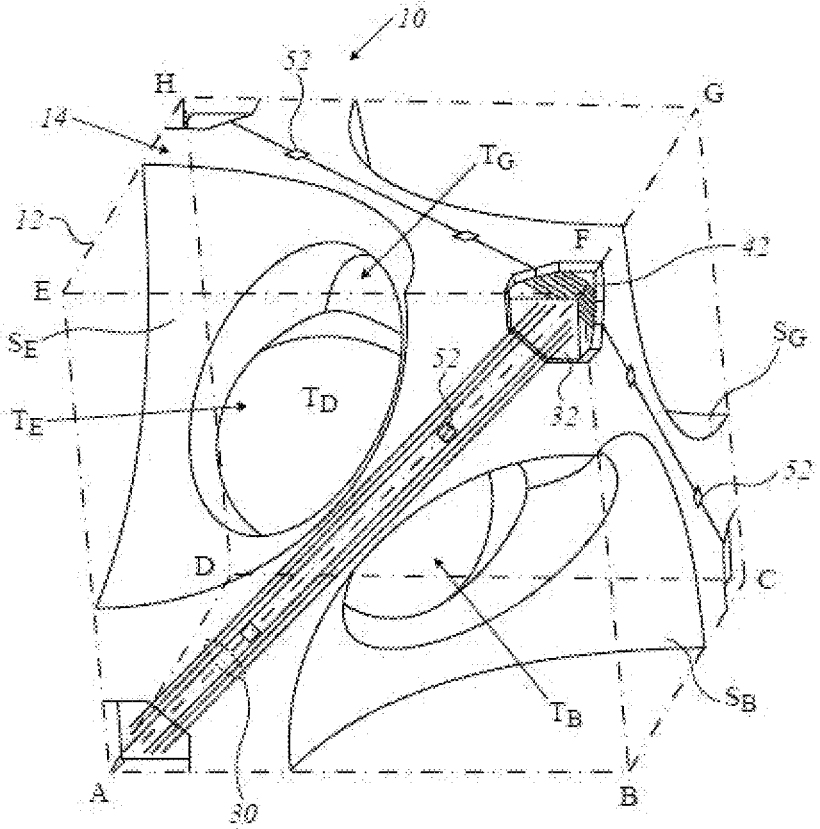
FIG. 1 Prior art
FIG. 2
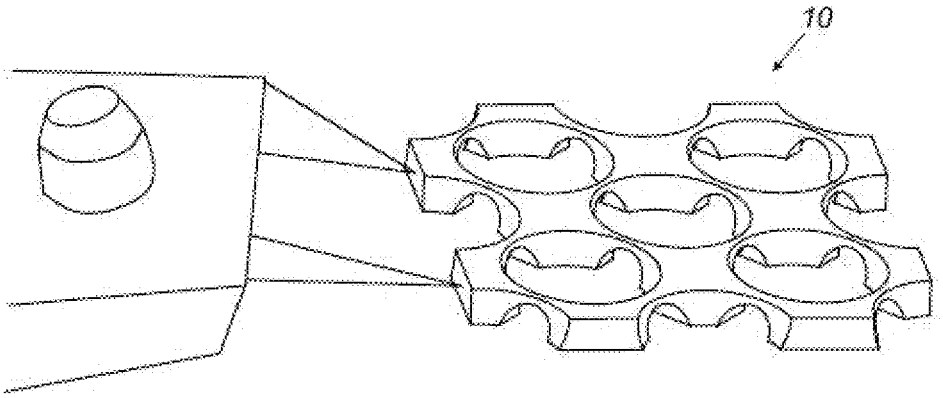

PERFORATED STRUCTURE MOUNTABLE ONTO A SEABED

CROSS-REFERENCE TO RELATED APPLICATIONS

This application is a continuation-in-part application of U.S. patent application Ser. No. 14/498,012, filed on Sep. 26, 2014, now abandoned, which is a continuation-in-part application of U.S. patent application Ser. No. 13/144,394, filed on Nov. 15, 2011, now abandoned, which claims priority from PCT International application No. PCT/IL2010/000036, filed on Jan. 14, 2010, and U.S. provisional patent application 61/144,745, filed on Jan 15, 2009. This application is also a continuation-part-application of U.S. patent application Ser. No. 13/319,750, filed on Oct. 1, 2012, now abandoned, which claims priority from PCT International application No. PCT/IL2010/000372, filed on May 9,2010, and U.S. provisional patent application 61/176,910, filed on May 10, 2009.

FIELD OF THE INVENTION

This invention relates to offshore structures and methods for their construction and more particularly to modular constructions useful for deep-water ports and artificial islands.

BACKGROUND OF THE INVENTION

The increasing globalization of the world economy has led to increased demands for international shipping. As a result of this increased demand, more and more cargo companies are placing orders for "jumbo" container ships with capacities of over 14,800 TEU (1 TEU or "Twenty-Foot Equivalent Unit"=1445 $ft^3$=the volume equal to that occupied by a 20'×8½'×8½' container) (J. Svendsen and J. Tiedemann, "The Big Ships Are Coming," web site article dated Jul. 17, 2007: http://containerinfo.co.ohost.de). While these large ships can improve the efficiency by which goods are transported, only some 20 ports worldwide can handle them, leading to additional transportation costs and loss of time due to the ensuing necessity of transshipment from a "hub port" to the cargo's ultimate destination.

Several obstacles hinder the development of additional ports capable of handling tomorrow's jumbo cargo ships. One is the lack of available coastal land for ports. Not only is the amount of coastal land suitable for port development inherently limited, but coastal land in general is valuable and desirable for development for other purposes (e.g. residential). A second obstacle is the lack of sufficiently deep water near the coast and the massive expense that additional dredging and construction of retaining walls entails. For example, between 2000 and 2005, the Kill van Kull channel (New York/New Jersey) was deepened from 35 feet to 45 feet at a cost of $360 million, and the project currently underway to dredge the channel to the 50 foot depth required for 7000-8000 TEU capacity ships will add more than $900 million to the overall cost.

There is a further fundamental obstacle to the development of new deep-water ports accessible to jumbo container ships, namely, the way in which ports are normally engineered. The basic design of seaports has remained essentially unchanged since the time of the Roman Empire: a breakwater is constructed to provide a harbor (i.e. area of calm water), and the port constructed within that harbor. While this design has been useful for literally two millennia, it suffers from three weaknesses that limit its usefulness to contemporary port design: (1) construction of the breakwater adds significantly to the cost of the seaport (one-third of the total)—and the cost of the breakwater increases as the square of its depth; (2) the need for constant dredging on the landward side of the breakwater adds additional expense to the maintenance of the port; (3) the wide slope of the breakwater prevents mooring of ships in close proximity to it, wasting the deepest and hence most useful part of the harbor.

In the face of these obstacles, it is of vital importance that new ways of thinking about seaport design be found. Such new approaches are still lacking, however. In U.S. Pat. Nos. 5,803,659 and 6,017,167, Chattey disclosed a method of using modular caissons for seaport construction or expansion. While this invention has the cost advantages brought about by the modularity and portability of the caissons used, the port itself remains tied to land, and hence does not remove the need for the expensive dredging operations described above in cases where the water is not sufficiently deep.

Others have disclosed various means of constructing modular underwater breakwaters (e.g. the inventions disclosed in U.S. Pat. Nos. 1,816,095; 3,844,125; 4,502,816; 4,978,247; and 5,393,169), but these breakwaters are generally designed for prevention of beach erosion rather than for use in a port. Even those modular units intended for use in construction of harbor breakwaters (e.g. those disclosed in U.S. Pat. Nos. 3,614,866; 4,347,017; and 5,620,280), while reducing costs of harbor construction, envision construction of a breakwater and the piers as separate entities.

U.S. Pat. No. 6,234,714 discloses a pier with a nominally integrated breakwater. As with the above-referenced patents, however, the breakwater and pier are in fact independent structures, in which the breakwater comprises a mound of sand, gravel, rocks, and/or rubble piled up against the seaward side of the pier, upon which a plurality of caisson-like structures are placed. Thus, this design also suffers from the problems that the breakwater cannot be constructed without extensive dredging operations and that the breakwater and the pier are not a single modular structure.

Thus, there remains a need for a new paradigm for deep-water port design and construction. In order to solve the problems discussed above, what is needed is a deep-water port or an artificial island in which the breakwater is integrated into the structure itself, eliminating the costs of a dedicated breakwater construction and maintenance; in which the structure itself can be constructed in deep water without the need for additional dredging; and in which the port can be built as an independent structure not needing any direct connection to dry land, eliminating the need for free coastal land as a prerequisite for port construction or expansion. The present invention is designed to meet these long-felt needs.

SUMMARY OF THE INVENTION

The present invention provides a solution to the problems described above and an answer to the need for a new way of thinking about port design. It is one object of the present invention to provide a perforated structure mountable onto a seabed for establishing a deep-water port or an artificial island. The aforesaid structure comprises: a plurality prefabricated perforated modules integratable into said structure; and at least one connector interconnecting corner portions of said prefabricated perforated modules.

It is a core purpose of the present invention to provide each prefabricated perforated module has a corner portion comprising a concave surface such that said corner portions being integrated together into said structure form a cavity to be filled with a concrete. The connector comprises a crosspiece having three arms orthogonal to each other; each arm has a cross-like cross section. The crosspiece has reinforcing members at least partially mechanically connectable to said corner portions.

It is another object of the invention to provide a method of establishing a deep-water port or an artificial island. The aforesaid method comprises the steps of (a) providing a plurality of prefabricated perforated modules integratable into said structure; each prefabricated perforated module has a corner portion comprising a concave surface such that said corner portions being integrated together into said structure form a cavity to be filled with a concrete; (b) providing at least one connector; (c) positioning corner portions of said prefabricated perforated modules such that a cavity surrounding said corner portions is formed; (d) mounting said connector comprising crosspiece having three arms orthogonal to each other within formed cavity; each arm has a cross-like cross section; said crosspiece has reinforcing members; (e) connecting said reinforcing members to said corner portions; and (f) filling said cavity with concrete.

BRIEF DESCRIPTION OF THE DRAWINGS

FIG. 1 shows one embodiment of a modular marine structure unit 10 (prior art, U.S. Pat. No. 7,226,245 assigned to Kent and Alkon) used to construct the breakwater underdeck 2;

FIG. 2 shows how the transport of a prefabricated modular unit 10 (or of an assembly comprising a plurality of interconnected units) to the site of the port;

DETAILED DESCRIPTION OF THE INVENTION

Figure 3:
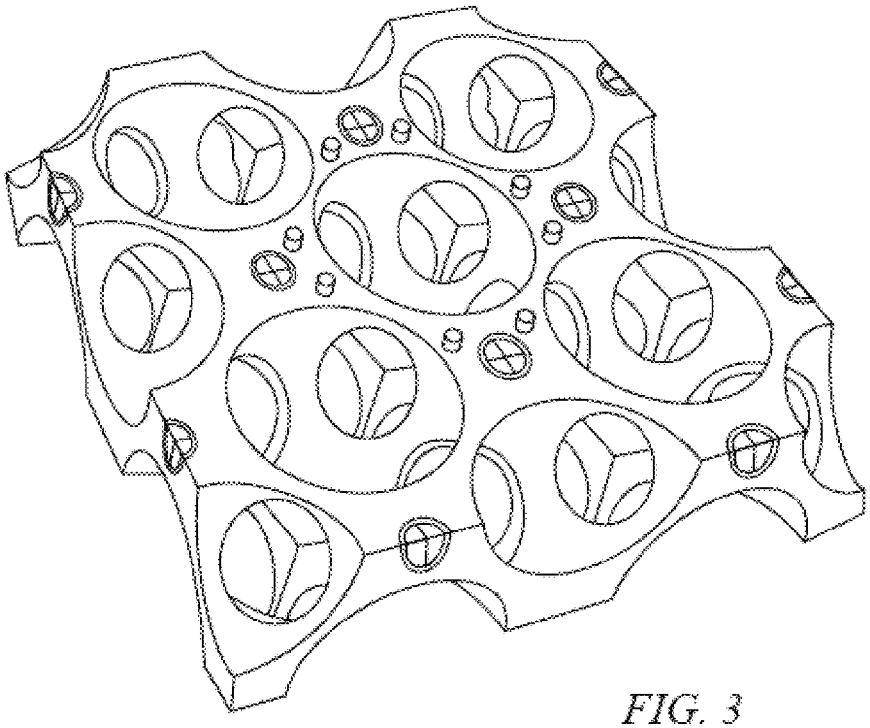
FIGS. 3 and 4 show top views of the assembled port with a cutaway view showing the placement of a modular unit 10, said modular unit being shown in one embodiment.

It will be apparent to one skilled in the art that there are several embodiments of the invention that differ in details of construction, without affecting the essential nature thereof, and therefore the invention is not limited by that which is illustrated in the figures and described in the specification, but only as indicated in the accompanying claims, with the proper scope determined only by the broadest interpretation of said claims.

We define the following terms to describe the invention:

Breakwater: a barrier designed to protect a harbor or shore from the impact of waves.

Perforated modular marine structure unit: a structural module for underwater construction, which has cut-outs or passages such that when immersed in a body of water, the water may pass through it.

With reference to FIG. 1, one embodiment of a perforated modular marine structure unit 10 is shown with a shape constituting a rectangular parallelepiped 12 defined by six planar faces with lower base vertices ABCD and upper base vertices EFGH. In the example shown, it is assumed without any limitations that the parallelepiped is a geometrical cube with sides about 10 m long. Four non-adjacent corners of the cube, in this case, B, D, E, and G, are cut out, leaving surfaces $S_B$, $S_D$ (not seen in the view illustrated in FIG. 1), $S_E$, and $S_G$. In the particular embodiment shown in FIG. 1, $S_B$, $S_D$, $S_E$, and $S_G$ have the shape of part of the surface of a sphere centered at the nearest corner, but they can have any shape bulging toward the cube's center (e.g. an ellipsoid or a more complex shape). Four tunnels $T_B$, $T_D$, $T_E$, and $T_G$ are formed and converge in the cube's center to form a tetrapod-like passage interconnecting the cut-out surfaces. The tunnels are shown as having a cylindrical cross-section, but they may be of other shapes. The six planar surfaces left from the faces of the original cube (e.g. surface 14, remaining from side EFGH) are base planes by which the perforated modular marine structure contacts other modules. These surfaces must be large enough to ensure stable positioning of the module on a substantially horizontal foundation during the assembly process.

In the particular embodiment shown in FIG. 1, the perforated modular marine structures are formed with reinforcing diagonal beams (RDBs) 30 extending along the six diagonals on the planar surfaces remaining from the faces of the original cube. The RDBs may comprise reinforcing elements, for example, steel rods 32, and material embedding the reinforcing elements, e.g. concrete. Recesses 42 are formed on the cube's surface at the corners of the module. When two to eight modular marine structure units 10 are arranged about a common corner, these recesses form cavities that serve as a mold for casting concrete or injecting grout to create corner joints. Similar recesses 52 may be formed along the diagonals, as shown in FIG. 1.

FIG. 1 shows one example of the design of a perforated modular marine unit, but the construction of the underdeck 2 is not restricted to this specific design for the modular units 10.

Figure 4:
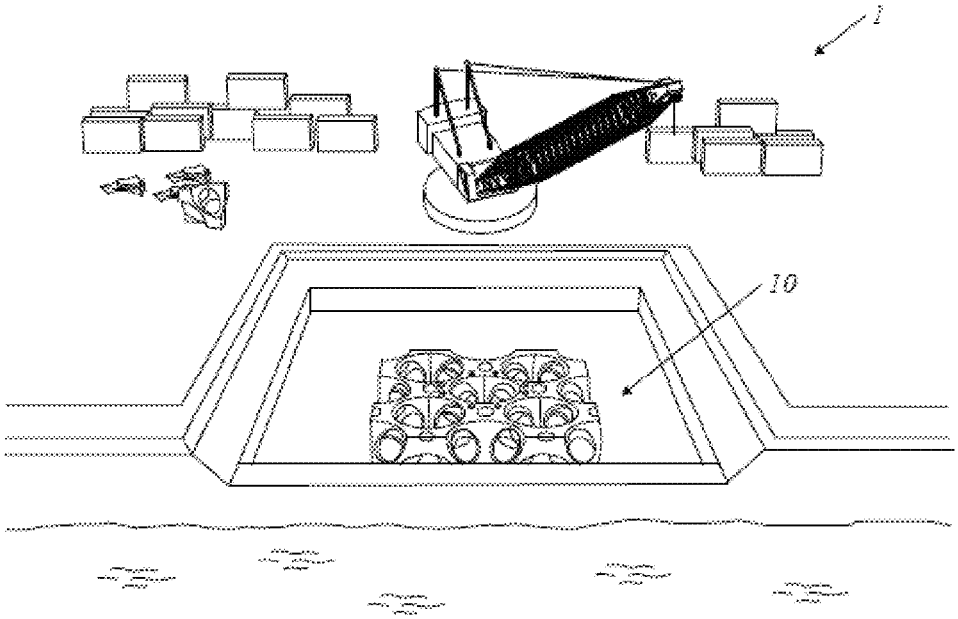

With reference to FIGS. 2-4, various stages in the construction of the underdeck 2 and integrated port 100 are shown.

Figure 5:
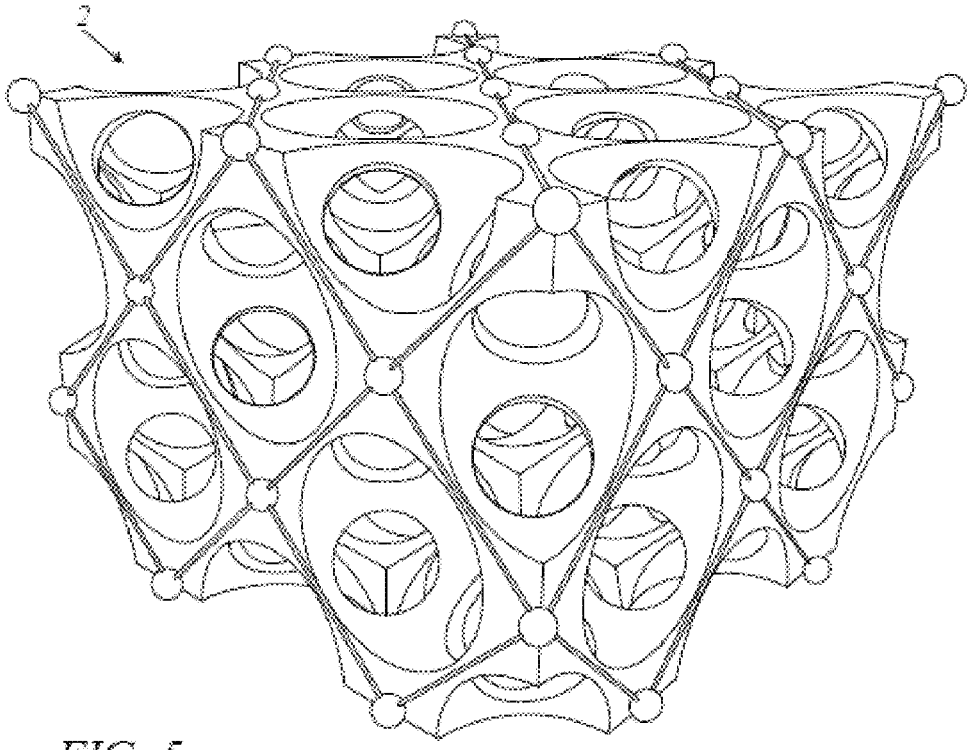
FIG. 5 shows a cutaway assembly diagram illustrating how modular structure units 10 are connected to form the breakwater underdeck 2.

With reference to FIG. 5, a detail of a section of the completed underdeck 2 is shown. The means by which the individual perforated modular marine units are interconnected, described above, is shown graphically in the figure.

Figure 6:
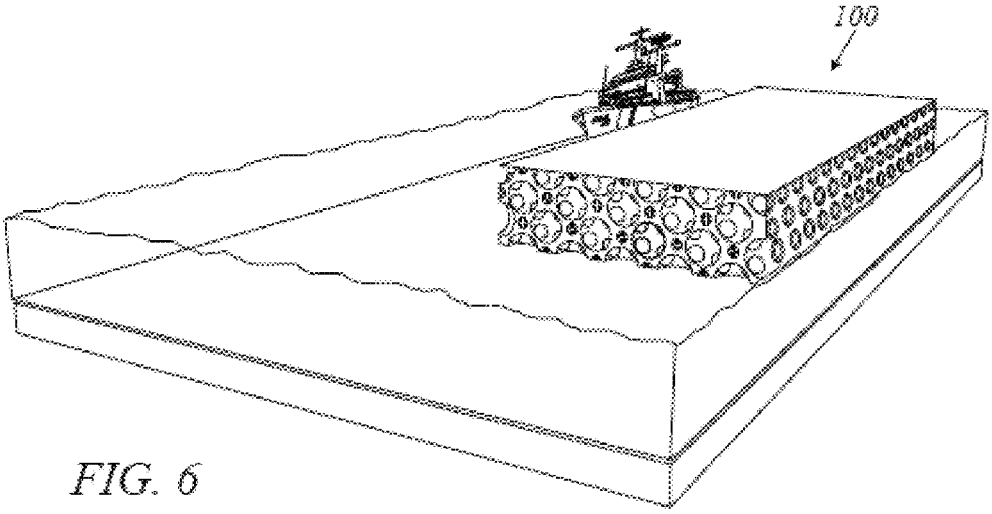
FIG. 6 shows a view of the fully-constructed port 100 showing the upper pier deck 1 and breakwater underdeck 2, illustrating how the fully-constructed port sits in the water.
Figure 7:
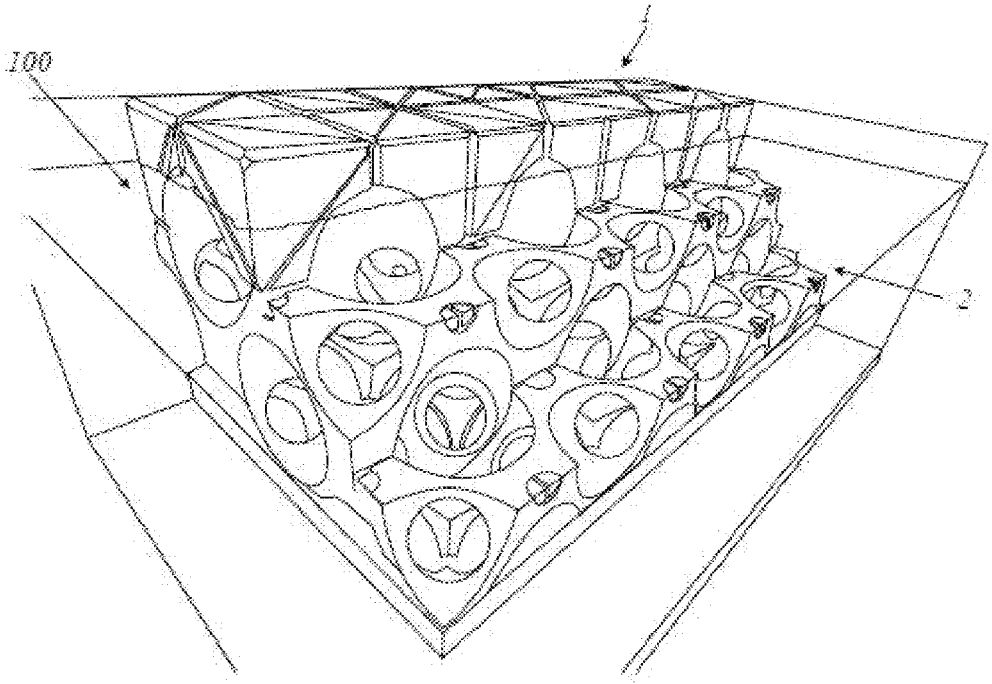
FIG. 7 shows a cutaway view of the port 100 illustrating the construction of the breakwater deck 2 from modular units 10 and the positions of the upper deck 1 and of the underdeck 2 relative to each other and to the water.
Figure 8:
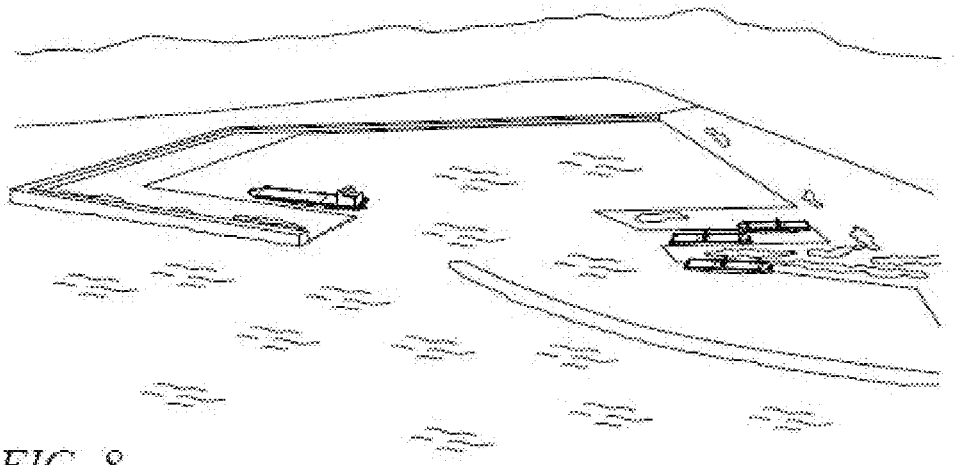
FIG. 8 shows a view of a harbor that includes an integrated deep water port 100.

With reference to FIGS. 6 to 8, an integrated deepwater offshore port 100 is shown which comprises an upper pier deck 1 and an under-deck 2. The upper pier deck is constructed of materials appropriate for use in salt water. It is designed for mooring of mega-ships, as a base for heavy cranes and other equipment used for on-loading and offloading of cargo to and from the ships, and as a temporary location for cargo to be loaded onto the container ships or to be transferred to the container terminal. The embodiment shown in FIGS. 6 and 7 shows the upper deck as having a rectangular profile, but due to the modular nature of the port's construction, the exact dimensions and shape of the upper deck will necessarily vary from embodiment to embodiment according to the specific needs of the port itself. Similarly, the exact dimensions and shape of the under-deck will be chosen in order to provide support for the upper deck, and will thus vary depending on the needs of the specific port being constructed.

The under-deck 2 is constructed from a plurality of perforated modular marine structure units 10. The perforated modular marine structure units are prefabricated and designed such that they are capable of interconnection, and are constructed from material that is compatible with long-term immersion in salt water. One embodiment of said perforated modular marine structure unit is presented in FIG. 1. This embodiment illustrates the essential qualities of the unit, in particular, its modularity (i.e. construction of the under-deck 2 is done by interconnecting a plurality of identical elements as illustrated in FIG. 5), its interconnectability, and its ability to allow water to pass through it. In this particular embodiment, water flows through cut out portions of the structure. In other embodiments, the unit may contain passages or be itself constructed from smaller sub-units in order to allow passage of water. The embodiment shown in FIG. 2 is provided to illustrate the construction of the integrated dock, and is not intended to limit its construction to use of the specific embodiment shown in the figure.

The under-deck sits directly on the natural sea floor and is constructed from prefabricated modular marine units 10 which are constructed on-shore, and the upper deck sits atop the mega-structure. The elements are interconnected (cf. FIG. 5) in dry dock. After the modular marine units are interconnected, a platform of at least one level is built. It is possible to build further structures atop the platform, with the platform itself serving as a foundation for the structures. After the work is completed in dry dock, the dry dock is filled with water to float the platform and everything on top of it. The platform is then towed (afloat) to its ultimate location in deep water, at which point water is allowed to enter the cavities within the modular marine units, causing them to sink to the sea floor, thus creating the breakwater port. Alternatively, the elements may be interconnected in wet dock and the port then towed to its ultimate location.

Because the under-deck is constructed from perforated units, it acts naturally as an efficient breakwater, providing still water on its landward side, and thus enabling the upper deck to act as a pier or wharf for cargo ships without the need for construction of a separate dedicated breakwater. The perforated units additionally can serve as a habitat for underwater flora and fauna, and hence, the under-deck as constructed can also serve as the basis of a man-made reef.

Figure 9:
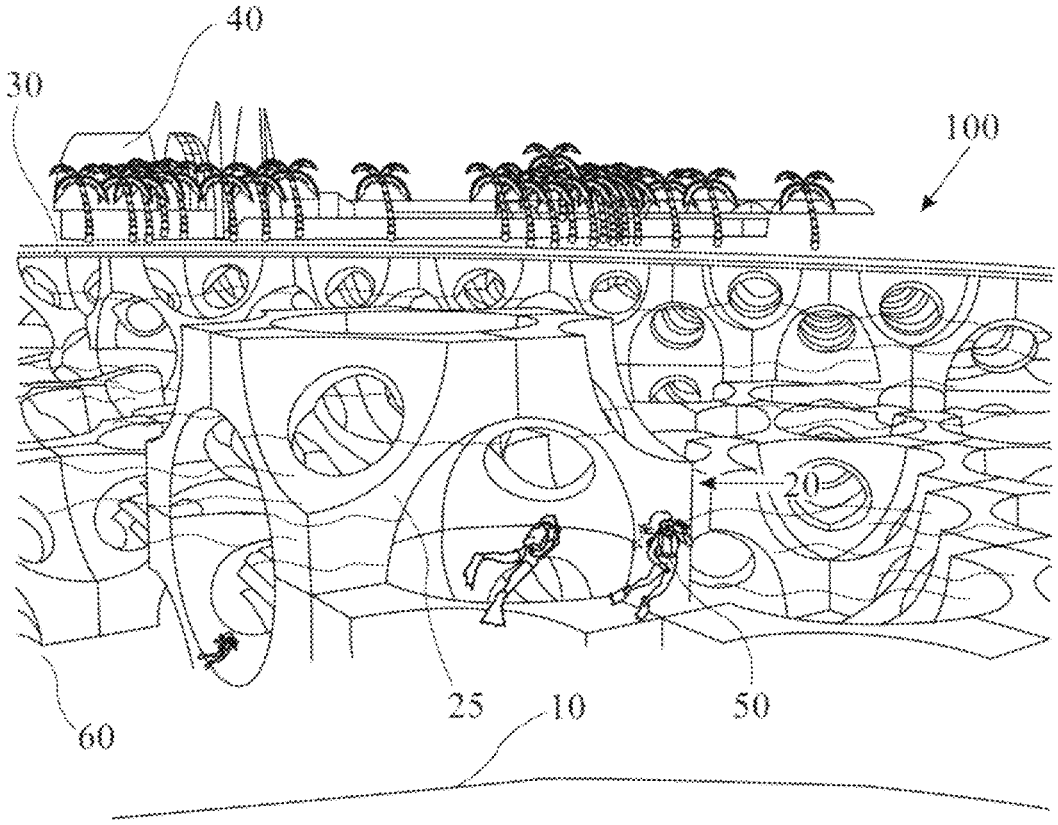
FIG. 9 is a schematic view of an environmentally friendly artificial island.
Figure 10:
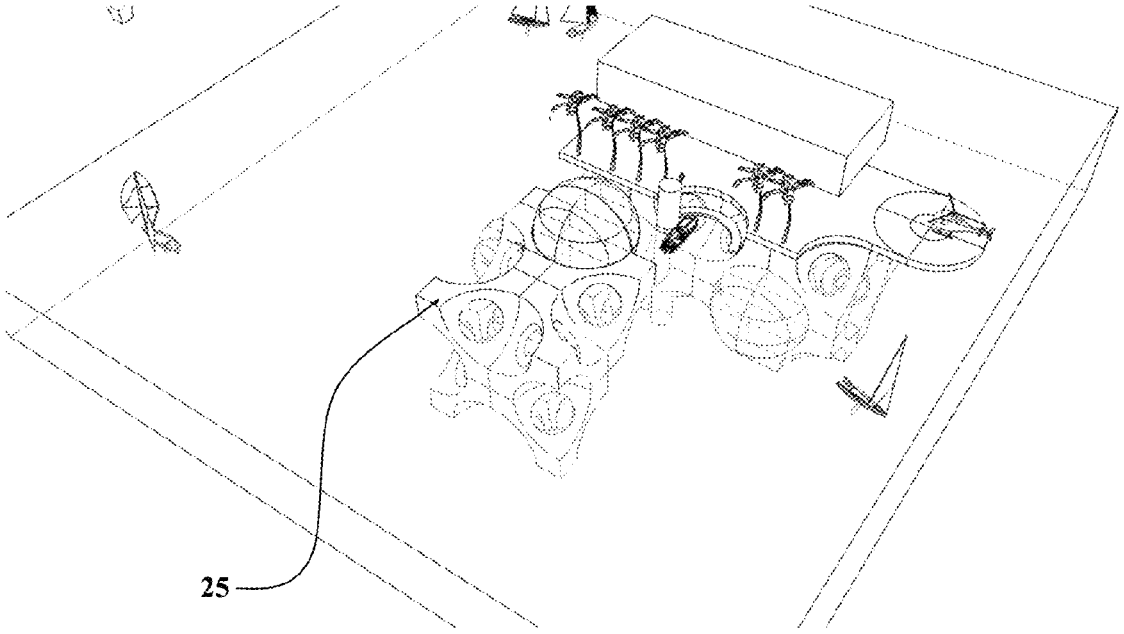
FIG. 10 is another schematic three-dimensional view of the environmentally friendly artificial island according to yet another design and embodiment.
Figure 11:
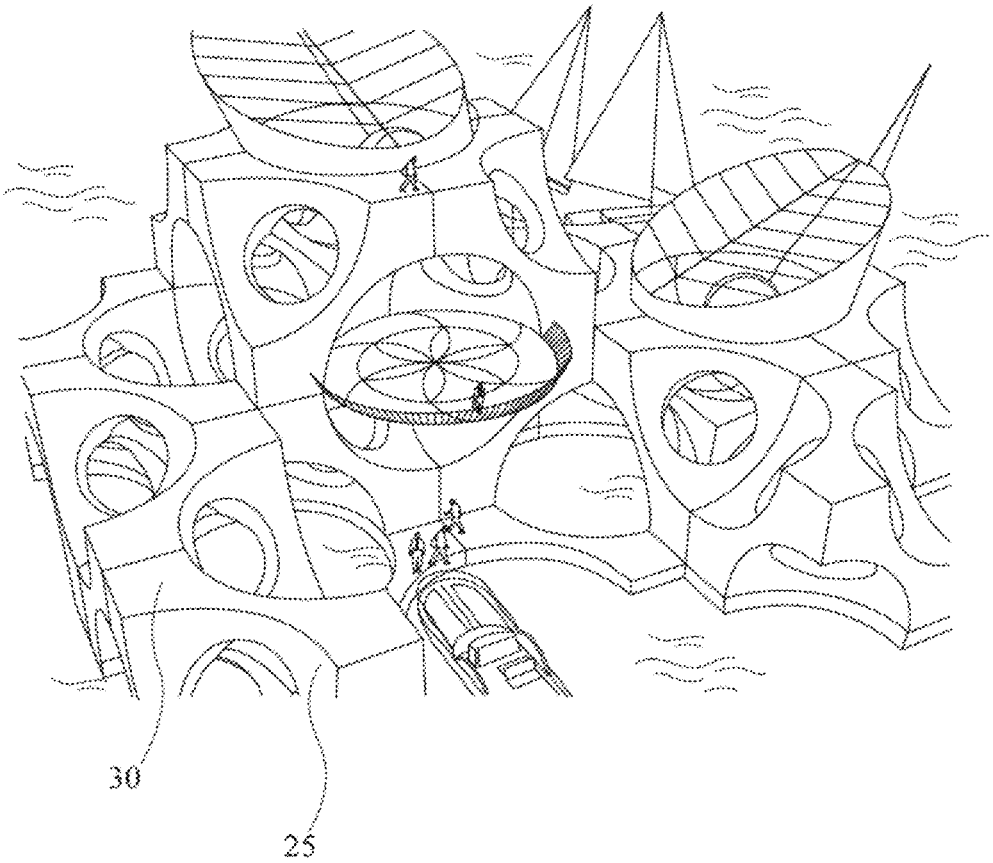
FIG. 11 is still another schematic three-dimensional view of the environmentally friendly artificial island according to yet another design and embodiment of the invention.

Reference is now made to FIGS. 9 to 11, showing a set of preferred embodiments of the current invention, the embodiments differ in their design yet pertain t the same inventive pith and marrow. An artificial island 100 comprises integrally configured an underwater portion 20, an above-water platform 30, and accommodation facilities 40. The underwater portion 20 further comprises at least one open-ended passageway and sits directly on a surface of a seabed 10. In accordance with one embodiment of the current invention, the underwater portion 20 is assembled from perforated modular units 25. The above-water platform 30 being mechanically fixated to the underwater portion 20 carries the accommodation facilities 40 on upper surface of the aforesaid platform 30. As seen in Figures, marine fauna 60 and a scuba diver 50 are indicated in sea water.

In accordance with another embodiment of the current invention, the underwater portion 20 is furnished with means for forming artificial reefs. The aforesaid means constitutes special metal, plastic or any other additional members mechanically connected to perforated modular units 25 to increase an area of contacting sea water to the underwater portion 20.

Figure 12:
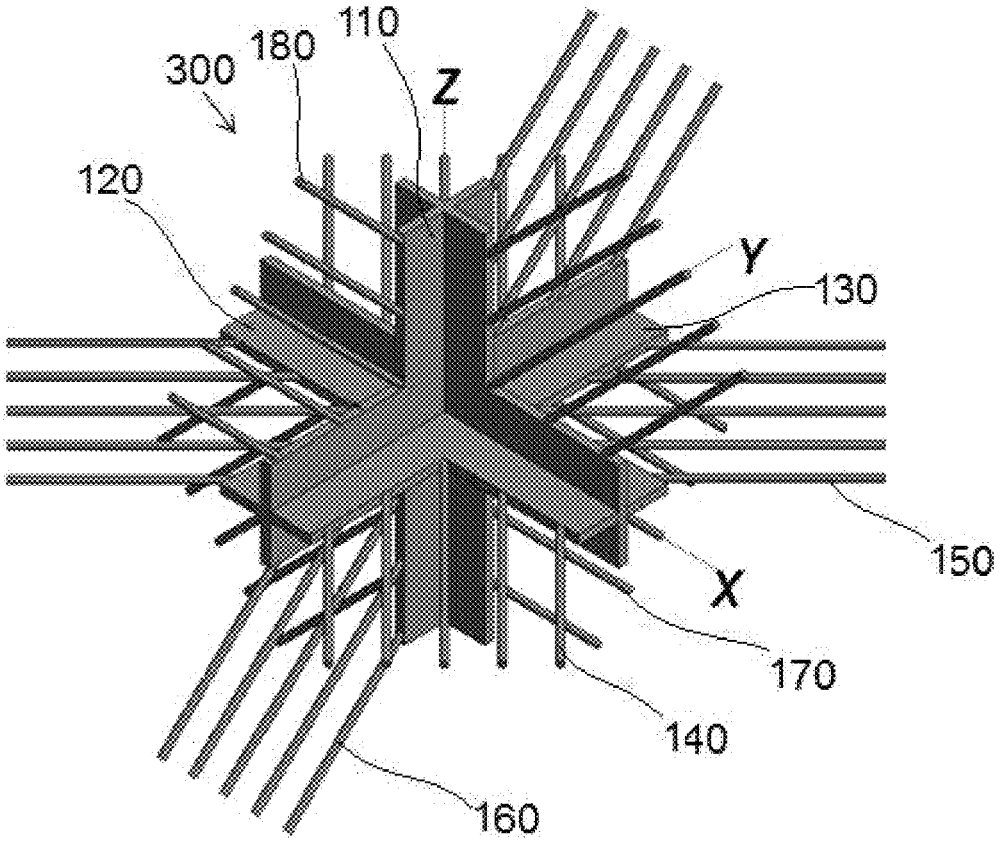
FIG. 12 is an isometric view of a connector for interconnecting prefabricated units.
Figure 13A:
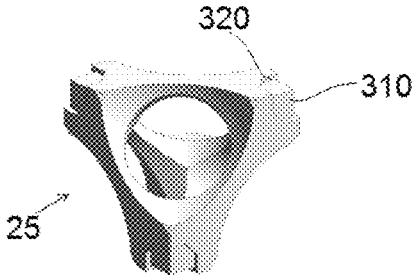
FIGS. 13*a* to 13*f* illustrates stages of establishing a structure mountable on a seabed.
Figure 13B:
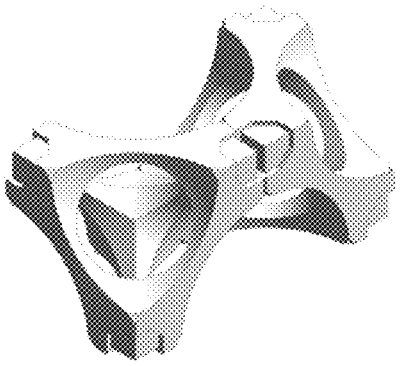
Figure 13C:
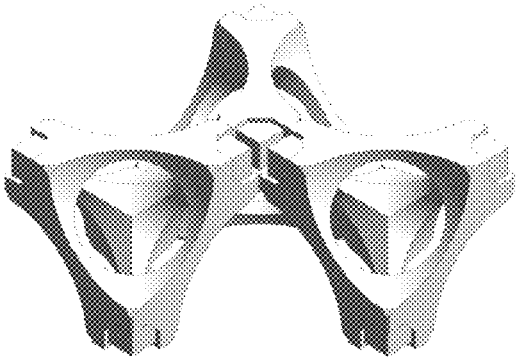
Figure 13D:
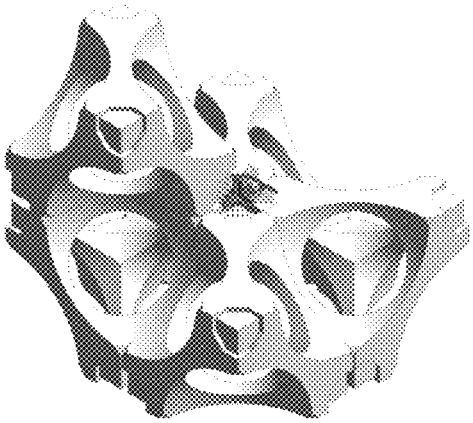
Figure 13E:
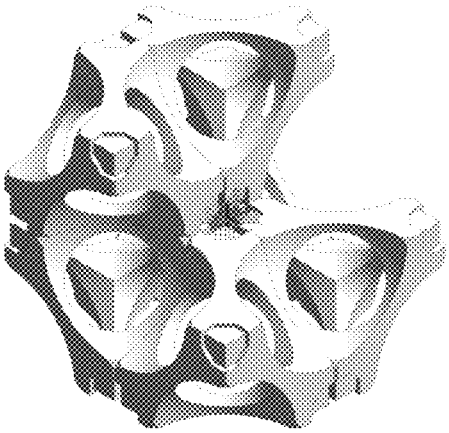
Figure 13F:
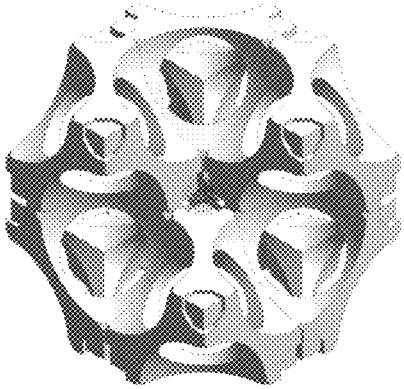

Reference is now to FIG. 12 showing connector 300 designed for interconnecting corner portions of units 25 (not shown). Connector 300 comprises a crosspiece having three arms 110, 120 and 130 orthogonal to each other. Each of arms 110, 120 and 130 has a cross-like cross section. Connector 300 is provided with reinforcing members 150, 160, and 170 which are in planes defined by 120-130 (X-Y), 110-130 (Y-Z) and 110-120 (X-Z). Additionally, reinforcing members exemplarily indicated as 140 and welded to arms 110, 120 and 130 are connectable to the corner portions of units 25.

Reference is now made to FIGS. 13*a* to 13*f* illustrating stages of establishing a structure mountable on a seabed. Numeral 210 refers to the corner portions of units 25. Corner portion 220 of each unit 25 is provided with concave surface 220 such that when units 25 are assembled into a structure to be established, these concave surfaces 220 forms a cavity to be fill with concrete (described below).

Figure 14:
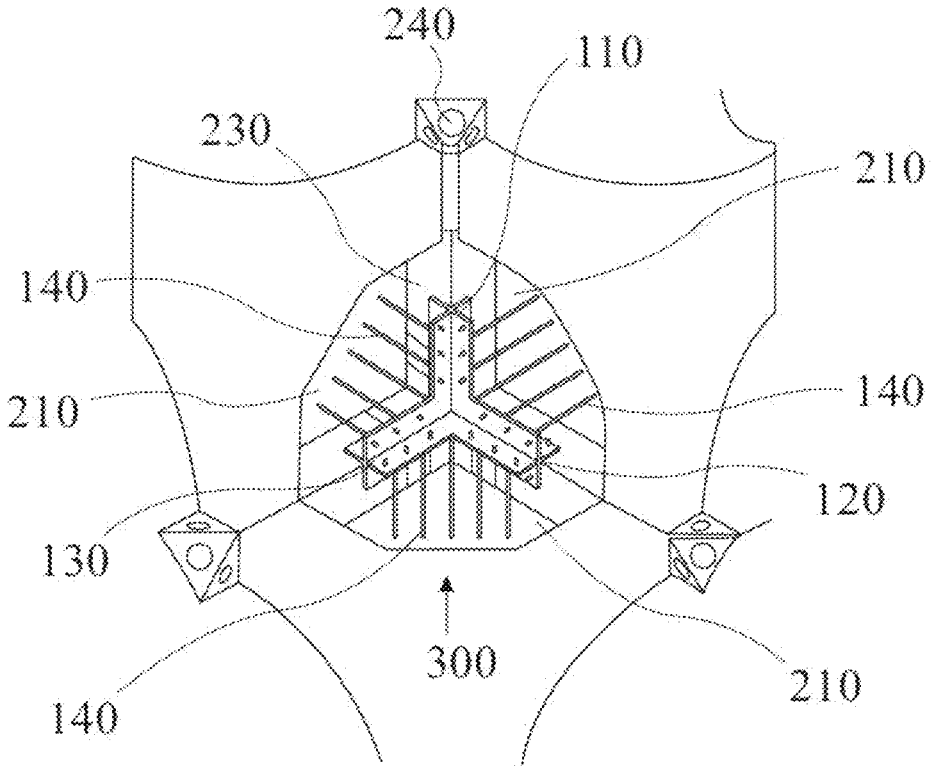
FIG. 14 is an isometric view of a connector for mounted within a structure mountable on a seabed.

Reference is now made to FIG. 14 showing connector 300 mounted into cavity 310. Connector 300 is mechanically connected to corner portions 210 of units 25 by reinforcing members 140. Connector 300 is mounted within cavity 230 which is filled with concrete after mounting all units 25 forming cavity 230. Filling with concrete is performed via channel 240.

Summarizing, units 25 are mounted such that surfaces 220 at corner portions 210 form cavity 230. Then, connector 300 is mounted into cavity 230. Thereat members 140 are mechanically connected to corner portions 210. Thereafter, cavity 230 is filled with concrete via channel 240.

What is claimed is:

1. A perforated structure mountable onto a seabed for establishing a deep-water port or an artificial island; said structure comprising:

a. a plurality of prefabricated perforated modules integratable into said structure;

b. at least one connector interconnecting corner portions of said prefabricated perforated modules;

wherein each prefabricated perforated module has a corner portion comprising a concave surface such that said corner portions being integrated together into said structure form a cavity;

wherein said connector comprises a crosspiece having three arms orthogonal to each other; each arm has a cross-like cross section;

wherein said crosspiece has reinforcing members distributed within said cavity; said cavity is fillable with a concrete.

2. A method of establishing a deep-water port or an artificial island; said method comprising the steps of a. providing a plurality of prefabricated perforated modules integratable into said structure; each prefabricated perforated module has a corner portion comprising a concave surface such that said corner portions being integrated together into said structure form a cavity to be filled with a concrete;

b. providing at least one connector;

c. positioning corner portions of said prefabricated perforated modules such that a cavity surrounding said corner portions is formed;

d. mounting said connector comprising crosspiece having three arms orthogonal to each other within formed cavity; each arm has a cross-like cross section; said crosspiece has reinforcing members;

e. connecting said reinforcing members to said corner portions; and f. filling said cavity with concrete.

* * * * *